US005878975A

United States Patent [19]

Stone et al.

[11] Patent Number: 5,878,975

[45] Date of Patent: Mar. 9, 1999

[54] WINDER RIDER ROLL ASSEMBLY

[75] Inventors: William M. Stone, Norton; Gerald A. Guild, Dalton, both of Mass.

[73] Assignee: Beloit Technologies, Inc., Wilmington, Del.

[21] Appl. No.: 982,598

[22] Filed: Dec. 2, 1997

[51] Int. Cl.[6] ..... B65H 18/20; B65H 18/26

[52] U.S. Cl. ..... 242/541.6; 242/541.3

[58] Field of Search ..... 242/541.4, 541.5, 242/541.6, 541.7, 541.3, 547

[56] References Cited

U.S. PATENT DOCUMENTS

| | | | |
|---|---|---|---|
| 4,180,216 | 12/1979 | Dahl et al. . | |
| 4,415,128 | 11/1983 | Heymanns . | |
| 4,867,387 | 9/1989 | Schönmeier . | |
| 4,883,233 | 11/1989 | Saukkonen et al. | 242/541.3 |
| 5,381,982 | 1/1995 | Adamski | 242/541.3 |
| 5,632,456 | 5/1997 | Kruger | 242/541.5 |
| 5,732,902 | 3/1998 | Tomma et al. | 242/541.5 |

OTHER PUBLICATIONS

"Jumbo Roll Winding" by Pauli Koutonen, apr Interntional Feb. 1996, pp. 67–71.

"Jumbo Roll winding" by Pauli Koutonen, Valmet Paper Machine Days 13–14, 1996, pp. 113–118.

"JR 1000 E Individualized High–Quality Rolls" Valmet.

*Primary Examiner*—John M. Jillions

*Attorney, Agent, or Firm*—Raymond W. Campbell; Gerald A. Mathews

[57] ABSTRACT

A method and apparatus for controlling the tension and position of a web roll being wound from a continuous traveling web, including a pair of winding drums supporting the winding roll in a pocket, positioning a pair of rider rolls with a looped belt span therebetween above the pocket on a beam and first pressing downwardly on the winding roll with a first rider roll, thereafter with the tensioned belt spanning the rider roll and the web roll, and thereafter with the belt and both rider rolls, while controlling the tension in the belt.

19 Claims, 7 Drawing Sheets

WINDER RIDER ROLL ASSEMBLY

BACKGROUND OF THE INVENTION

The present invention relates to improvements in paper-making machinery and, more particularly, to a paper web winder wherein a continuous traveling web material, such as paper, is wound onto a core and into a wound web roll.

In high speed winding of a web, such as paper web being wound into a roll, the web is conventionally started on a core and the roll wound on the core is supported and driven in rotation. The support is frequently provided by two horizontal winding drums. One or both of the drums are driven in rotation and the approaching web winds over one of the drums onto the winding roll at relatively high speeds, frequently substantially in excess of 4,000 feet per minute. It is imperative that winding the web onto the winding roll progress uniformly so as to maintain a constant tension of the web on the roll and to insure that the wound web roll is uniform. Uncontrolled progression of the winding can result in non-uniform tension of the web on to the roll and distortions in surface quality and non-uniformity of the cylindrical shape and density of the roll. It is also necessary to control the high speed of rotation of the winding so as to mitigate or eliminate vibration and the winding roll must be maintained controlled in the pocket between the winding drums.

One factor in maintaining control and quality of the roll being wound is to apply a downward force on the winding roll which affects the nip pressure between the roll and the supporting drums. The force also must be applied in a manner so that the vibration and hopping or bouncing of the roll, or other forms of vibration, do not occur. It is necessary to take into consideration several factors, such as any lack of control of the nip pressure between the supporting drums and the roll; holding the roll positioned in the pocket so that the speed of the roll surface will not change; the size of the roll and its weight will change very substantially during the winding process. The high speed rotation of a roll of substantial size and weight as the roll being wound is very difficult to control, and vibration or bouncing are two modes of disturbances which should be avoided.

These modes are characterized by repetitive radial motion, sometimes called buzzing, against a winding drum, which affects wound roll speed and quality. Another adverse effect is rocking, which takes the form of repetitive angular motion alternating in direction along an arcuate path, sometimes known as thumping, which occurs with respect to the winding drum. This is a less frequent problem than the radial motion. The bouncing or vibration of the paper roll in a double drum winder wherein the roll is supported on two parallel drums is a cause for reduced production during the winding operation.

The paper maker observes the problem as audible buzzing or a rocking thumping back and forth on the winding drums. He will attempt to adjust tension on the web or pressure of the rider roll on top of the wound roll to control the bouncing, generally with little success. It then becomes necessary to reduce speed until the buzzing or thumping is controlled. This vibration or bouncing not only causes production difficulties requiring slowing of the winding process, but it also creates maintenance problems. As to the mechanism itself, looseness of parts will occur, foundation cracks and excessive wear and fatigue of the metal of parts can occur.

This operation with accompanying bouncing can also be extremely dangerous to personnel in the vicinity of the winder because of the high kinetic energy of a roll rotating at over 4,000 feet per minute when the roll weighs several thousand pounds. This disturbance in the roll continues to be generated around the circumference of the roll until it closes to form a repeating cycle. Thus, the bouncing becomes a harmonic of the wound roll rotation. The initial disturbance may be caused by many factors, including uneven paper surface, machine direction basis weight variations, caliper variations, eccentric starts, variations in paper or paper-to-steel frictional characteristics, glue, unwinder drums and winder chevrons. Once this disturbance occurs, the next disturbances which follow are related to the energy available or the deformable nature, diameter and roll characteristics (friction) of the wound roll.

Adjusting web tension or rider roll pressure is in effect an attempt at changing the deformable nature of the paper roll. It is difficult to have much control over the problem by making these adjustments. A poorly wound roll is generally the only result.

The amount of web tension wound into a paper roll is affected largely by rolling nips on the outside of the paper roll during the winding process. In a conventional two drum winder there are three of these rolling nips, one at each drum, and one at the rider roll. The amount of tension induced is a function of the nip force and an inverse function of the radius of curvature of the nipping roll or drum. A hard nip, such as provided by a steel roll, induces more tension than a softer nip, such as provided by an elastomeric tire or an unsupported belt.

To produce a roll of paper with good internal structure, it is necessary to induce high tension in the paper roll when winding is first started on the core, and then reduce that wound-in tension as the roll builds up to its final diameter.

Reducing the rewinding roll speed generally reduces the tendency for the initial disturbance to deform the roll, and it reduces energy available to sustain the vibration. It is also a means of reducing or stopping winder bounce, but does not, of course, result in being able to maintain production speeds.

The two drum winder actually presents a mass elastic system which can be envisioned as consisting of a rotatable mass having deformable springs on fixed drums. That is, the reaction force between the supporting drums and the roll is resilient in nature, having a spring constant. With this, the natural frequencies can be calculated. These natural frequencies change with change in roll size. The rider roll engaging the top of the wound roll provides another force relationship which interacts with the spring constant. Thus, the resiliency of the roll engaged at three points of support, i.e., the two supporting drums, and the rider roll, can provide an unstable unit when operating at high speeds.

Efforts to control bouncing have included adding a vibration absorber to the rider roll, but this has not proven to fully solve the problem.

SUMMARY OF THE INVENTION

The problems and deficiencies associated with prior winders in controlling the internal web tension structure in a wound paper web roll have been addressed and alleviated by this invention.

In this invention, a looped belt is tensioned between first and second rider rolls which, in turn, are mounted on a beam for substantially vertical movement relative to the paper web roll being wound in a two-drum type of winder. The beam is moveable in a tilting fashion to position one or both of the rider rolls, or the span of the tensioned belt, against the paper web roll. The amount of tilting of the beam is controlled as a function of the size of the paper roll being wound.

By tilting the two rider rolls and the tensioned belt looped between them, the nip force against the paper web roll being wound can be selectively varied between the force provided by the first rider roll alone, without any force provided by the tensioned belt, or the force provided by a combination of the first rider roll and a portion of the tensioned span of the belt, or by the tensioned span of the belt alone, or by the forces provided by both rider rolls and the span of the tensioned belt extending between the first and second rider rolls. All of this is selectively controlled by varying the amount of tilting of the beam on which the two rider rolls are rotatively mounted as well as the position of the rider rolls relative to a portion of the upper peripheral surface of the paper web roll, all according to the diameter of the paper web roll.

Accordingly, the method and apparatus of this invention begins with winding a new core, which has been inserted in a pocket formed between the two drums in a two-drum type of winder, to be in nipping engagement with both of the support drums. The first rider roll is initially brought into contact with the paper web roll in a relatively hard nipping engagement to provide a corresponding relatively high web tension in the first few turns of the on-coming traveling paper web onto the core to begin the winding of a paper web roll. As the wound paper web roll increases in diameter, the rider roll beam rotates such that the nip between the rider roll apparatus, comprising the two rider rolls and the looped belt tensioned between them, gradually is transferred to the tensioned belt to provide a relatively soft nip against the paper web roll while the paper roll is still at a relatively small diameter. This applies enough nip force to control the web tension in the wound paper roll without inducing high web tension at the outside of the paper web roll.

As the paper web roll increases in diameter, the nip provided by the rider apparatus is selectively varied, in the manner described previously, to create the desired web tension in the wound paper roll as a function of the diameter of the paper roll.

An object of the present invention is to provide an improved rider roll system for a high speed winder capable of minimizing disturbances in the roll being wound and capable of applying a downward-applied control force in an improved manner.

It is further an object of the invention to provide an improved paper web winder which is capable of high speed continuous winding operation wherein bouncing, vibration, and other deleterious binding effects are minimized by the use of an improved rider roll system.

A still further object of the invention is to provide an improved rider roll and control system for a high speed winder wherein the structure applies unique control and downward pressure forces to the roll being wound and does so in an automatic fashion.

Other objects, advantages and features, as well as equivalent structures and methods, which are intended to be covered herein, will become more apparent with the teaching of the principles of the invention, in connection with the disclosure of the preferred embodiments, in the specification, claims and drawings, in which:

DETAILED DESCRIPTION OF THE PREFERRED EMBODIMENTS

Figure 1:
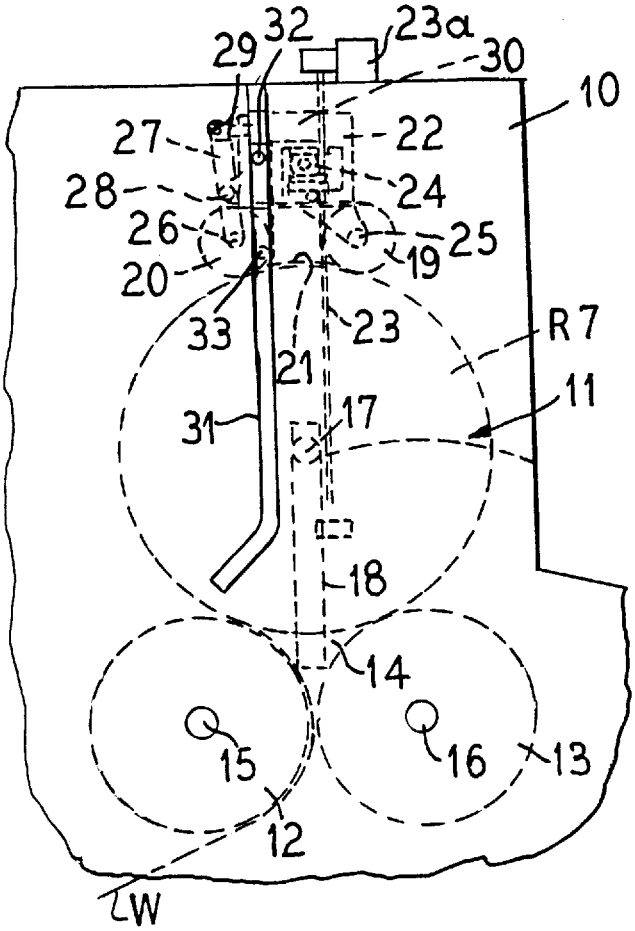
FIG. 1 is a side elevational view of the winder, shown in somewhat schematic form, constructed and operating in accordance with the principles of the present invention with elements shown in broken lines as behind the framework of the supporting structure.

As illustrated in the assembly in FIG. 1, a winder, such as is designated generally by number 11, with a paper roll R7 substantially fully wound. The winding mechanism is shown in the sequence of winding as the roll progresses in size, starting from a core 17, on which one or two wraps of paper web are wound to begin the formation of a small diameter wound web roll R1 in FIG. 2 and progressing as shown by the rolls of increasing diameter size at R2, R3, R4, R5 and R6 in FIGS. 3–7, respectively.

The roll which is winding from a continuous traveling web W is supported in a pocket 7 (FIG. 6) formed between two supporting winding drums 12 and 13. As the winding begins, the web is started on the core at 17, FIG. 2, and the winding drums 12 and 13 are driven in rotation feeding the web W on to the winding roll R2–R6 as it grows in size.

Figure 2:
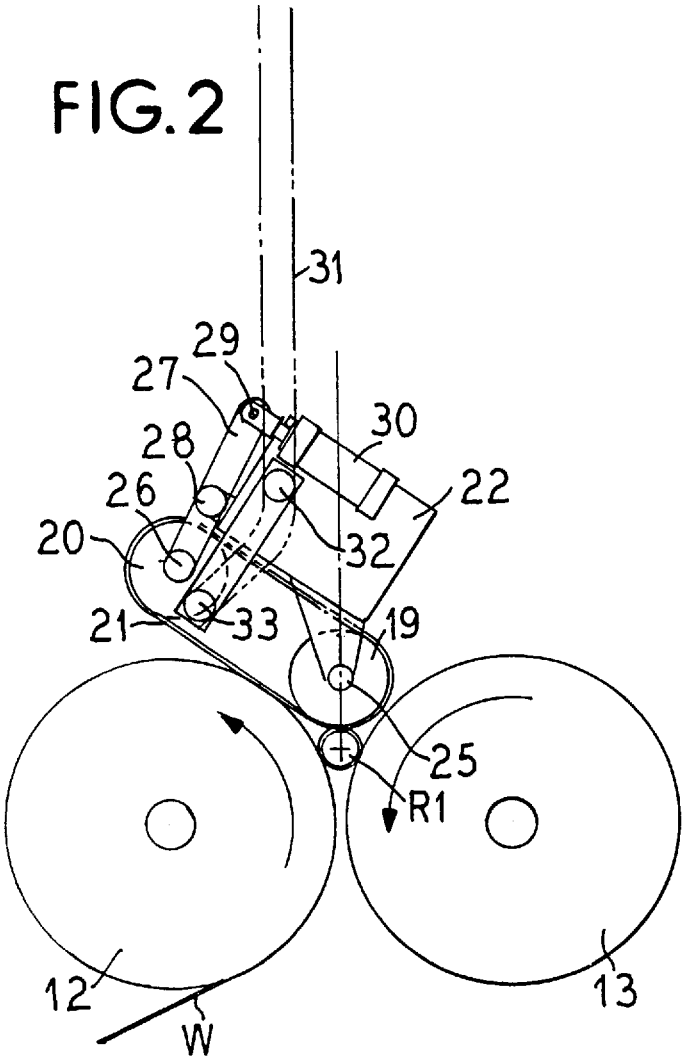
FIGS. 2–7 are side elevational views showing the structure of a winder operating in accordance with the principles of the present invention, and sequentially illustrating the positions of the rider system as the winding roll builds up in size.

A downward force is applied to the winding roll in a unique manner progressing as shown in the progression of FIGS. 2–7. The rider roll assembly, which is, or system, designated generally with the number 5 in FIG. 2, is supported on a beam 22. The beam carries first and second rider rolls 19 and 20 which have a belt 21 stretched therebetween with the tension in the belt being controlled.

Sequentially, the winding roll core 17/small diameter roll R1 is first down weighted or held in the pocket by the first rider roll 19, and subsequently by the belt 21 and thereafter by both rider rolls 19 and 20 in conjunction with the belt 21. In accordance with the method of the invention the transfer of the downward force by the rider rolls and belt is automatically changed in accordance with the pre-determined program as a function of the increase in diameter of the winding roll.

The manner in which the downward force is applied changes sequentially, first with the first rider roll 19, then with the belt 21 and then with the belt in conjunction with the two rider rolls. Clearly, there is a transition period between these steps where the downward force is comprised of a combination of the rider roll nips, one or the other, or both, in conjunction with the tensioned belt. The precise amount of downward force applied is controlled consistent with the method in which the force is applied, by a screw elevator, hydraulic cylinder, or other suitable means which acts on the beam 22, which beam supports the rider rolls on the belt. This screw elevator shown at 23 in FIG. 1 operated by a suitable motor 23*a*. Fine tuning of the amount of force apply to the beam 22 or to the amount of relief given to the beam is accomplished by an air spring 24 which is positioned between the screw elevating mechanism 23 and the beam 22. The amount of downward force applied to the winding roll determines the nip pressure between the roll and the winding drums 12 and 13 and thereby the tension of the web wound on to the roll is controlled. The present arrangement provides an improvement in the manner in which the downward force is applied such that a greater downward force can be applied directly by the first rider roll 19 when the winding roll is started, as the winding roll increases in size and weight this downward force can be relieved, but better control on the winding roll is achieved, thus reducing its tendency to vibrate or bounce without having to apply an amount of downward force which would cause the roll to be wound too tight with the web W. The downward force applied on to the beam 22, or the amount of lift given to the weight as the winding roll progresses is controlled by predetermined program such as by computer control of the elevating screw 23 and the air spring 24 all in relation to the manner in which the downward force is applied sequentially by the first rider roll 19 nipping the belt over the web roll being wound, then by the belt 21 tensioned in the span between rider rolls 19, 20, and then by both rolls 19 and 20 with the belt 21 where both rider rolls nip the belt over the web roll being wound and the tensioned belt is held taut against an arcuate segment of the surface of the web roll being wound.

The beam 22 is mounted so that its angular, or slanted, position can be controlled as it moves upwardly as the diameter of the winding roll increases during the winding process. This angular position is determined by the shape of the lower end of a generally vertically extending cam track 31 which has cam followers 32 and 33 riding in the track. The cam followers are secured to the beam 22 so that as the beam moves upwardly as the diameter of the web roll being wound increases, the followers follow the pre-shaped track 31. The track is located in an end of the winder frame 10 shown in FIG. 1.

The rider roll 19 is rotatably supported to be rotated on a fixed axis 25 (e.g., a shaft) on the beam 22. The second rider roll 20 is mounted on the beam on a movable axis 26 (e.g., a shaft) carried on a rocker arm 27 FIGS. 1 and 2. The rocker arm applies a force to the pivotal support 26 for the second rider roll 20 to thereby adjust the tension of the belt 21. The belt 21 may be a single span or plurality of individual belts extending along the length of the roll which is being wound. The tension of the belt is determined by a force on the rocker arm 27 applied by an air cylinder and piston 30 which is pivotally connected to an upper end of the rocker arm at 29. The rocker arm is pivoted on a pivot 28 on the beam so that as the piston of the air cylinder pulls inwardly as shown in FIG. 2, the rocker arm tends to pivot in a clockwise direction pulling the belt 21 more tightly and increasing its tension.

In operation, the roll being wound, which is shown as fully formed as R7 in FIG. 1 is initially wound on a core 17 positioned between the support drums. The core may or may not be guided in a vertical guide 18 which is mounted in, or is a part of, the winder frame.

As winding begins on the core 17 in its pocket position as shown in FIG. 2, a downward control force holding the core in the pocket is provided by the rider roll 19 riding on the top of the roll R1 and applying a downward vertical force.

Figure 3:
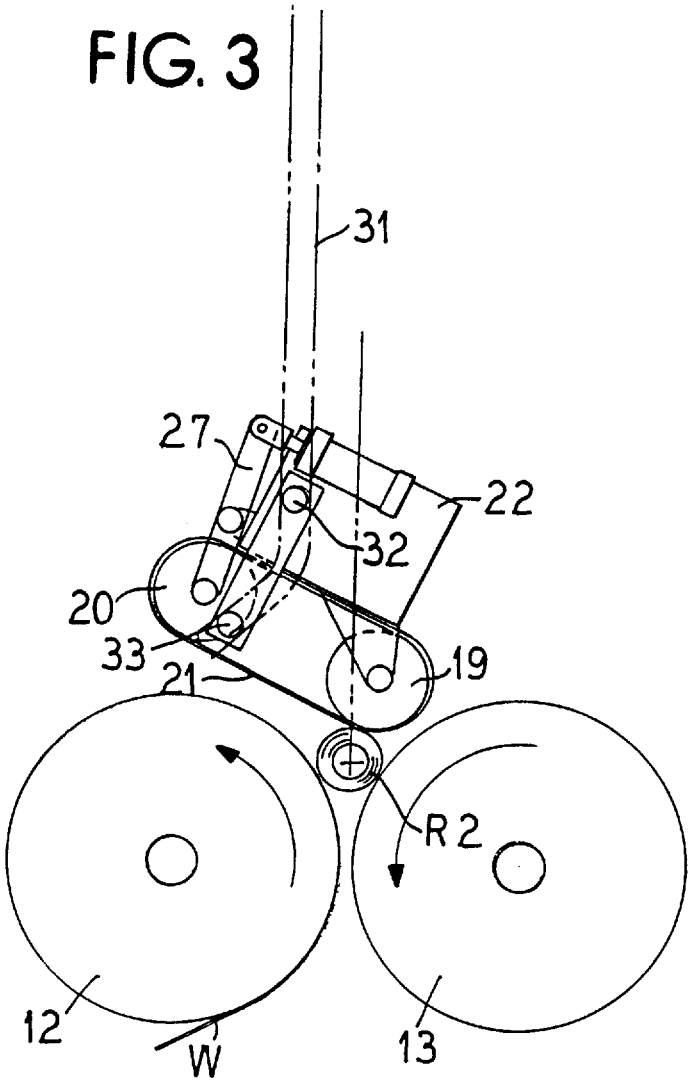

As the roll begins to build in size shown as R2 in FIG. 3, the beam 22 is moved upwardly by rotating the right side of the beam counterclockwise as the uppermost cam follower 32 moves along a substantially straight upwardly path in cam track 31 while the lowermost cam follower 33 moves along an arcuate path having a horizontal component of travel. The cam followers 32 and 33, sliding in the track 31 maintain the rider roll 19 substantially over the top of the roll at diameter R2 maintaining a downward control force holding it in the pocket and controlling the nip force between the roll at R2 and the support drums 12 and 13.

Figure 4:
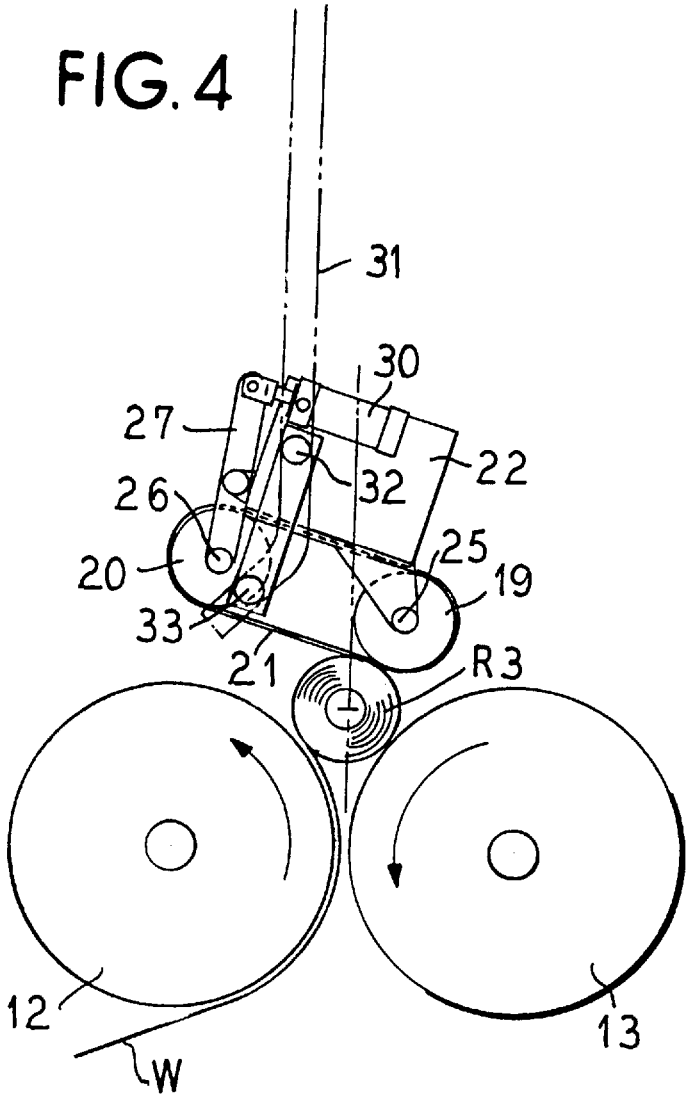

As the roll diameter builds still further to diameter R3 in FIG. 4, the beam 22 raises upwardly commensurate with the increase in roll diameter and the cam followers 32 and 33 in the track 31 continue the rotation of the beam 22 to begin the transfer the downward force on to the winding roll from substantially the nip of rider roll 19 to where the downward force is applied by a combination of the rider roll nip force and the tensioned belt 21.

Figure 5:
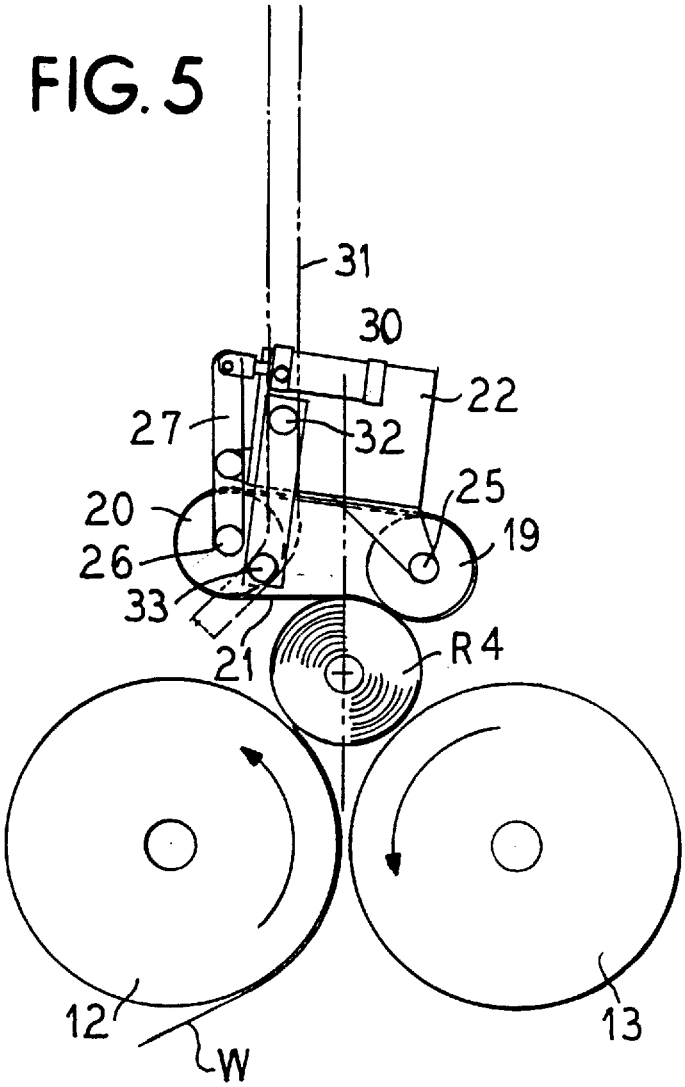

This downward pressure continues as the winding roll builds up more in diameter as shown at R4 in FIG. 5 to where a greater portion of the belt 21 wraps the winding roll and the force of the rider roll system is provided substantially by the tensioned belt 21.

Figure 6:
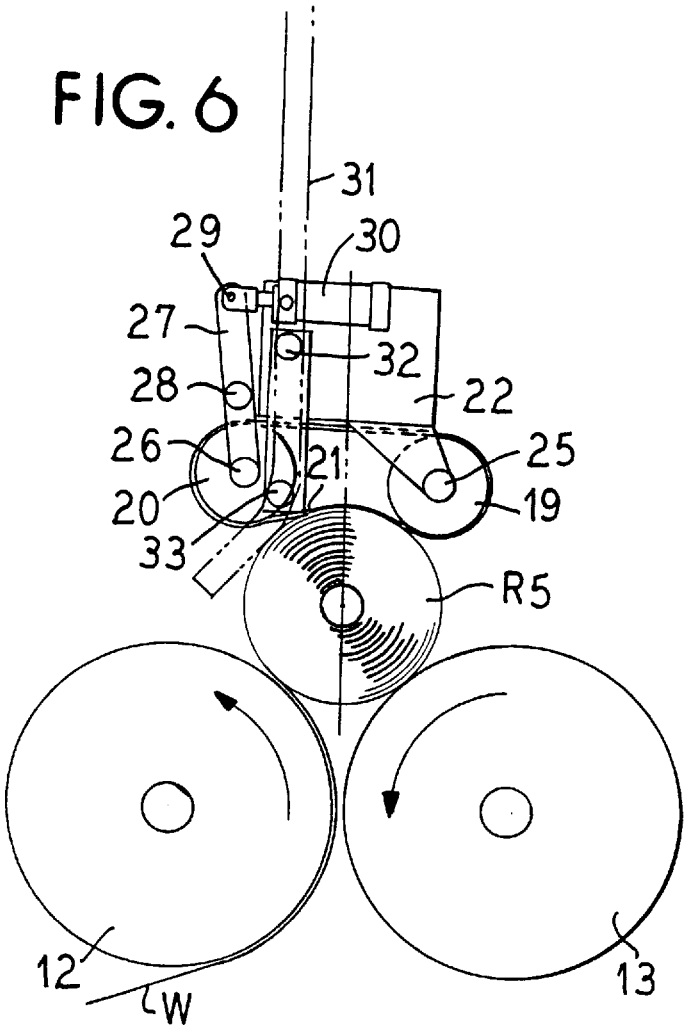

Progressing still further in the winding of the wound web roll it reaches the diameter shown at R5 in FIG. 6. At this point the cam followers 32 and 33 have progressed still further up the cam track 31 to where they are almost in vertical alignment. At this point, the downward pressure by the rider roll system is still applied somewhat by the first rider roll 19, but it is principally applied by the tensioned belt 21. Simultaneously the double acting piston 30 will have control of the tension in the belt by causing the rocker arm 27 to apply a tension force to the second rider roll 20.

Figure 7:
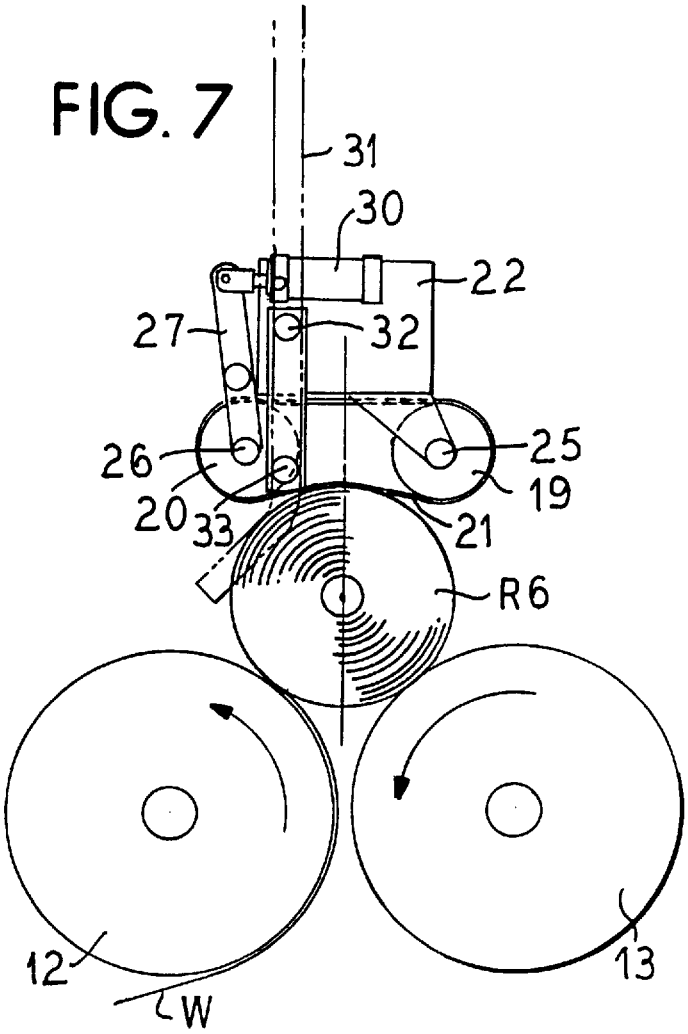

As the winding roll builds up still further to the diameter R6 shown in FIG. 7, the roll is subjected to a downward control force by a combination of the tensioned belt and the two nipped rider rolls 19 and 20. By control of the tension in the belt 21 the amount of wrap of the belt onto the winding roll at diameter R6 is controlled. With a substantial wrap as shown, the controlled vertical force includes horizontal components so that very firm control is obtained on the winding roll R6 without having to apply excessive vertical force. In other words the wrapping of the belt 21 applies a superior controlled force to the winding roll R6 than if a single rider roll alone was used to apply a downward force as has been the situation with structures heretofore available. As the roll increases in size, the tension in the belt can be reduced thereby increasing the wrap and thereby decreasing the downward total force applied to the winding roll at diameter R6. The fine tuning of the force is, of course, obtained by coaction with the air spring 24.

While the equipment shown for regulating the elevation of the beam 22 is a screw and follower, and fine tuning is obtained by an air spring 24, it will be appreciated by those versed in the art that other equivalent mechanisms may be employed. Also while the control of the pivotal angle of the beam 22 is obtained by followers in a cam track, other mechanisms may be employed for controlling this pivotal position (e.g., attitude) of the beam 22. The objective, of course, is to regulate the sequential application of the downward force on the roll being wound, first with the first rider roll, and then with the first rider roll and the tensioned belt, and then the arrangement such that the force provided by the rider roll system is provided by the tensioned belt so that the winding roll in effect is cradled between the two rider rolls. In some instances, further refinements may be desired where the beam is tilted to an attitude such that, while the belt wraps the top of the roll being wound, one rider roll may be positioned slightly lower so that the effective resultant component of force supplied downwardly on the roll being wound is optimum relative to the nip pressure desired between the roll being wound and the winding drums 12 and 13. In some instances an exact vertical force may not be desired but one which is at a slight angle with a vertical.

In operation the mechanism is programmed such that with a given grade of paper web which is to be wound, and the speed of winding, that the type of downward rider roll control force is predetermined for the web roll being wound at different diameters. The overall mechanism is then programmed so that the total downward force or pressure applied by the first rider roll and thereafter the belt with the two rider rolls are controllably changed as a function of the increase in size of the roll being wound. Thus, not only is the amount of downward pressure controlled by the manner in which the pressure is applied is controlled, such as by controlling the angular position of the beam which determines whether the first rider roll applies the sole downward force or the forces are applied by a combination of the first rider roll and the belt, or by the belt alone in coaction with the two rider rolls. The control and downward force of the belt is also coordinated by control of the tension on the belt which is achieved by the double acting piston 30 to obtain that the predetermined tension in the belt which belt applies an elastic compliant controlled force as its tension is controlled.

Finally, it is contemplated that, after the rider roll system has had its attitude rotated through the positions where the first rider roll alone nips the web roll being wound, through the successive steps where the rider roll force is provided by the first rider roll in combination with the tensioned belt, then either by the tensioned belt alone or by the tensioned belt in conjunction with the first and second rider rolls, the final rider roll system force might be again provided by either the first or second rider rolls alone in nipping engagement with the web roll being wound through the belt.

Thus it will be seen there has been provided an improved method of controlling the roll being wound in a high speed winder. The critical factors of the amount of downward force applied and the amount of control obtained are regulated in an improved manner.

As is apparent from the foregoing description, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A winder for winding a continuous traveling web into a wound web roll comprising, in combination:

support means providing a winding pocket supporting a web roll being wound from the beginning core to a fully wound web roll;

a rider roll means disposed above the pocket positioned for applying a downward force onto the winding web roll at the beginning of winding of the winding web roll;

the rider roll means including a web roll-engaging looped belt positioned to form a nip with the winding web roll and for applying downward pressure thereto subsequent to the pressure applied by the rider roll means; and drive means operatively linked with the looped belt to drive the belt for traveling engagement with the web roll being wound; and means for changing the application of the rider roll means to the winding web roll for sequentially applying the rider roll to the winding web roll and thereafter applying the traveling belt to the winding web roll.

2. A winder for winding a continuous traveling web into a wound web roll comprising, in combination:

support means providing a winding pocket supporting a web roll being wound from a beginning core to a fully wound web roll;

a rider roll beam above the pocket;

first and second rider rolls rotatably carried on the beam, said beam moving upwardly as the wound web roll increases in size;

a roll-engaging looped belt threaded over the rider rolls having a tensioned span between the first and second rider rolls;

drive means operatively linked with the looped belt to drive the belt for traveling engagement with the web roll being wound;

a control means controlling the position of the rider rolls with only the first rider roll engaging the wound web roll at an initial position of the winding; and said tensioned span of the belt controllably engaging the wound web roll as the diameter of the wound roll increases.

3. A winder for winding a continuous traveling web into a wound web roll constructed in accordance with claim 2, wherein:

said support means includes a pair of parallel drums providing the roll support pocket therebetween and supporting the winding web roll with the web threaded over one of the drums to be wound on the winding web roll.

4. A winder for winding a continuous traveling web into a wound web roll constructed in accordance with claim 2, wherein:

said control means engages both of said first and second rider rolls onto the winding web roll subsequent to the application of the tension span of said looped belt.

5. A winder for winding a continuous traveling web into a wound web roll constructed in accordance with claim 2, further including;

elevation means for elevating said beam and providing support therefore.

6. A winder for winding a continuous traveling web into a wound web roll constructed in accordance with claim 5, further including:

force control means mounted on the beam and operatively linked with at least one of said first and second rider rolls for providing a fine tuning of the force between the beam and the beam elevation means.

7. A winder for winding a continuous traveling web into a wound web roll constructed in accordance with claim 6, wherein:

said force control means comprises an air spring.

8. A winder for winding a continuous traveling web into a wound web roll constructed in accordance with claim 2, further including:

cam means operatively linked with the rider roll beam for controlling the position of said first and second rider rolls as said rider rolls move upwardly with increase in size of the winding web roll.

9. A winder for winding a continuous traveling web into a wound web roll constructed in accordance with claim 8, wherein:

said cam means includes a shaped cam track, on the winder, and cam followers on the beam, for controlling the rotational position of the beam and the position of the rider rolls for sequentially positioning the rider rolls for applying sequential forces to the winder rolls, as desired.

10. A winder for winding a continuous traveling web into a wound web roll constructed in accordance with claim 2, wherein:

said rider rolls are rotatably supported on the beam and said beam is pivotally mounted to said control means for controlling the pivotal position of said beam and the rider rolls relative to the web roll being wound.

11. A winder for winding a continuous traveling web into a wound web roll constructed in accordance with claim 2, further including:

tension means for controlling the tension in said belt over said tension span so that the wrap of the belt over, and the force against, the winding web roll is controlled.

12. A winder for winding a continuous traveling web into a wound web roll constructed in accordance with claim 2, further including:

force means for applying a separating force to said rolls for controlling the tension in the tension span of the belt means.

13. A winder for winding a continuous traveling web into a wound web roll constructed in accordance with claim 2, wherein:

said first rider roll is rotatably fixed on the beam and the second rider roll is movable for controlling the tension in the belt means; and force means is provided to the second rider roll for controlling the tension in said belt means.

14. A method of winding a continuous traveling web into a wound web roll in a winder, comprising the steps:

supporting a horizontally disposed winding web roll from beneath and driving the web roll in rotation in a roll support pocket in the winder from a beginning core to a fully wound web roll;

applying a downward force on the winding web roll aiding and controlling the wound tension in the roll including first supplying a downward force on the winding roll by a first rider roll in nipping engagement with the winding web roll; and subsequently applying a downward force by a looped, tensioned belt wrapped over the rider roll and over an arcuate portion of the periphery of the winding web roll.

15. The method of winding a continuous traveling web into a winding web roll in accordance with the steps of claim 14, wherein the step of applying a downward force includes looping the looped belt over a second rider roll such that the downward force against the web roll after the nipping engagement by the first rider roll is produced next, at least in part, by the tensioned belt extending in a tensioned span between the first and second rider rolls, and then by the tensioned belt in conjunction with the first and second rider rolls in nipping engagement with the winding web roll.

16. The method of winding a continuous traveling web into a winding web roll in accordance with the steps of claim 14, further including the step of:

controlling the tension in the belt to control the downward pressure applied to the winding web roll and the amount of wrap over a portion of the upper periphery surface of the web roll.

17. The method of winding a continuous traveling web into a winding web roll in accordance with the steps of claim 14, further including the step of:

moving the first and second rider rolls and the looped belt upwardly as the diameter of the winding roll increases.

18. The method of winding a continuous traveling web into a winding web roll in accordance with the steps of claim 17, further including the step of:

fine tuning the rate of speed with which the first and second rider rolls and belt are moved upwardly so as to control the force between the winding web roll and the rider rolls and the belt as the winding web roll grows in diameter.

19. The method of winding a continuous traveling web into a winding web roll in accordance with the steps of claim 18, further including the step of:

controlling the tension in the belt such that the force of that belt against the web roll is controlled, as desired.

* * * * *